US006043595A

United States Patent [19]

Yokoyama et al.

[11] Patent Number: 6,043,595

[45] Date of Patent: Mar. 28, 2000

[54] SHADOW MASK HAVING A CURVED SURFACE WITH COMPRESSED, STRENGTHENING DENTS

[75] Inventors: Shoichi Yokoyama, Hanyu; Tadashi Ite, Himeji; Fujio Takahashi, Yokohama, all of Japan

[73] Assignee: Kabushiki Kaisha Toshiba, Kawasaki, Japan

[21] Appl. No.: 08/967,615

[22] Filed: Nov. 10, 1997

[30] Foreign Application Priority Data

Nov. 11, 1996 [JP] Japan ..... 8-298333
Nov. 18, 1996 [JP] Japan ..... 8-306138

[51] Int. Cl.[7] ..... H01T 29/80

[52] U.S. Cl. ..... 313/402; 313/403; 313/407; 313/408

[58] Field of Search ..... 313/402, 403, 313/404, 407, 408, 461, 476, 477 R

[56] References Cited

U.S. PATENT DOCUMENTS

| | | | |
|---|---|---|---|
| 3,809,945 | 5/1974 | Roeder | 313/402 |
| 3,862,448 | 1/1975 | Ishizuka et al. | 313/402 |
| 3,872,345 | 3/1975 | Yamazaki et al. | 313/403 |
| 3,916,243 | 10/1975 | Brown . | |
| 3,923,566 | 12/1975 | Law . | |
| 4,048,536 | 9/1977 | Brown . | |
| 4,131,822 | 12/1978 | Branton . | |
| 4,727,280 | 2/1988 | Fujimura . | |
| 5,384,511 | 1/1995 | Fujimura . | |

FOREIGN PATENT DOCUMENTS

| | | |
|---|---|---|
| 60-240028 | 11/1985 | Japan . |
| 5-25653 | 4/1993 | Japan . |

*Primary Examiner*—Nimeshkumar D. Patel
*Assistant Examiner*—Mack Haynes
*Attorney, Agent, or Firm*—Pillsbury Madison & Sutro LLP

[57] ABSTRACT

A shadow mask including a perforated portion that has a desired curved surface shape is obtained by pressing a flat mask having electron beam apertures. The press-molded perforated portion of the shadow mask is compressed in its thickness direction in a manner such that it is sandwiched between a first compression mold, having a convex surface that faces a concave surface of the perforated portion in which smaller holes of the electron beam apertures open and a plurality of projections on the convex surface, and a second compression mold, having a smooth concave surface that faces the convex surface of the perforated portion in which larger holes of the electron beam apertures open. In doing this, the perforated portion is locally compressed by means of the projections of the first compression mold, whereby a plurality of recesses are formed on the concave surface side of the perforated portion.

5 Claims, 5 Drawing Sheets

SHADOW MASK HAVING A CURVED SURFACE WITH COMPRESSED, STRENGTHENING DENTS

BACKGROUND OF THE INVENTION

The present invention relates to a shadow mask used in a color cathode-ray tube and a manufacturing method therefor.

In general, a color cathode-ray tube is provided with a shadow mask that serves as color selecting means. The shadow mask is formed by integrally working a metal sheet that is relatively thin as a whole, and includes a curved-surface section in the form of a substantially spherical convex surface and a skirt section, which extends substantially at right angles to the curved-surface section and surrounds its whole periphery. The curved-surface section includes a perforated portion having a large number of electron beam apertures and a nonperforated peripheral edge portion on the outer periphery of the perforated portion.

Usually, the shadow mask of this type is manufactured by press-molding a flat mask that is composed of an initially flat metal sheet having the electron beam apertures. After the flat mask is first annealed so that it can be molded with ease, it is press-molded into a specified shape by means of a pressing mold. After the press-molding, the shadow mask surface is blackened so that an oxide film is formed thereon, whereupon the shadow mask is completed.

For various reasons, the thickness of shadow masks has recently been reduced to, for example, 0.12 to 0.13 mm or thereabout. As a result, the strength of the press-molded shadow masks is lowered, arousing a problem of deformation by an external impact.

Conventional press-molding is carried out in a manner such that a mask material is stretched in the surface direction by means of a mold, most commonly a punch mold, with a planished surface. Accordingly, stresses are concentrated on the perforated portion and peripheral edge portion of the shadow mask, so that the electron beam apertures are liable to suffer deformation called aperture elongation. Thus, the extent of plastic working of the shadow mask has its limit.

It is difficult, therefore, to work the whole perforated portion of the shadow mask uniformly. As a result, the mask inevitably includes local underworked portions, and is partially slackened or sagged. In this state, the whole shadow mask is not plastic yet, so that the molded mask cannot maintain its shape if it is dropped with an impact. The thinner the shadow mask, the more remarkable this effect is.

This problem can be solved by thickening the shadow mask. However, this solution is contradictory to the tendency toward thinner shadow masks, and makes it difficult to maintain the given shape of the electron beam apertures that are formed by etching.

BRIEF SUMMARY OF THE INVENTION

The present invention has been contrived in consideration of these circumstances, and its object is to provide a shadow mask with good strength against an external impact, which can undergo satisfactory plastic working without changing the shape of apertures even with use of a thin sheet as its material, and a method of manufacturing the same.

In order to achieve the above object, a shadow mask according to the present invention comprises a curved-surface section formed by working a metal sheet and having the shape of a curved surface, and a skirt section surrounding the curved-surface section throughout the circumference. The curved-surface section includes a perforated portion provided with a large number of electron beam apertures and a nonperforated peripheral edge portion situated on the outer periphery of the perforated portion, and the perforated portion has a plurality of recesses formed in one surface thereof by compressing the perforated portion in the thickness direction thereof.

In the shadow mask described above, each of the electron beam apertures includes a larger hole opening on the convex surface side of the perforated portion and a smaller hole opening on the concave surface side of the perforated portion, and the recesses are formed in a concave surface of the perforated portion.

The recesses radially extend substantially from the center of the perforated portion to the peripheral edge thereof. Alternatively, the recesses are distributed substantially throughout the perforated portion and are substantially in the form of a hemisphere each.

Further, a manufacturing method of a shadow mask according to the invention comprises the steps of preparing a flat mask formed of a metal sheet including a perforated portion provided with a large number of electron beam apertures, curving the perforated portion of the flat mask into a specified shape by pressing, and compressing the press-molded perforated portion of the metal sheet in the thickness direction thereof, thereby forming a plurality of recesses in one surface of the perforated portion.

The step of forming the recesses includes locally compressing that surface of the perforated portion in which the respective smaller holes of the electron beam apertures open.

An alternative manufacturing method of a shadow mask according to the invention comprises the steps of preparing a flat mask formed of a metal sheet including a perforated portion provided with a large number of electron beam apertures, and curving the perforated portion of the flat mask into a specified shape by pressing using a punch having a specific shape, and at the same time, compressing the perforated portion of the metal sheet in the thickness direction thereof, thereby forming a plurality of recesses in one surface of the perforated portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
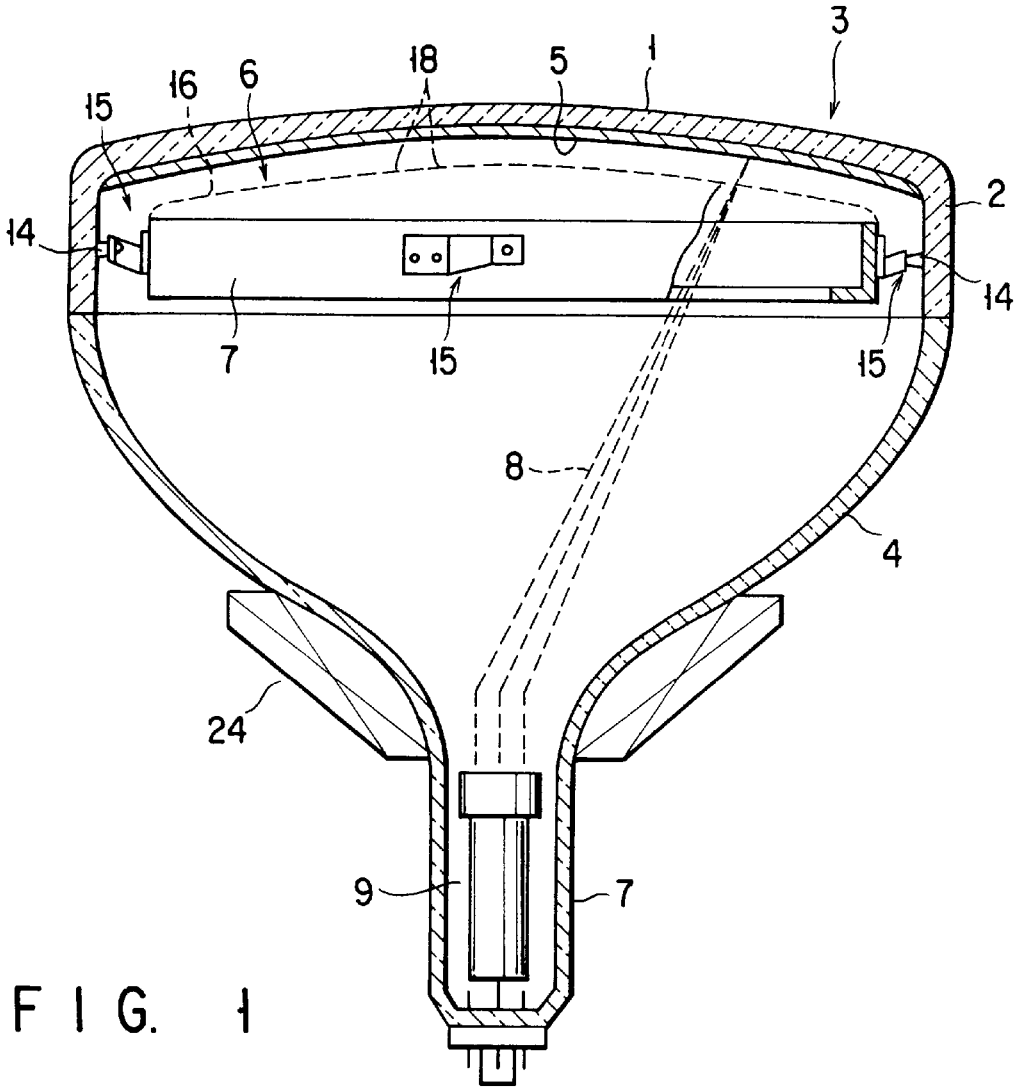
FIG. 1 is a sectional view of a color cathode-ray tube provided with a shadow mask according to an embodiment of the present invention.
Figure 2:
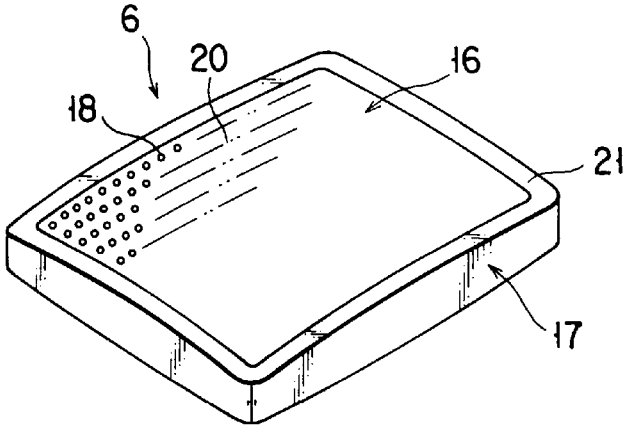
FIG. 2 is a perspective view of the shadow mask.

Preferred embodiments of the present invention will now be described in detail with reference to the accompanying drawings. FIG. 1 shows a color cathoderay tube that is provided with a shadow mask. This color cathode-ray tube comprises a vacuum envelope, which includes a face panel 3 formed of glass and a funnel 4. The face panel 3 includes a substantially rectangular effective section 1 and four side wall sections 2 set up on the peripheral edge portion of the effective section, and the funnel 4 is connected to the side wall sections 2. A stud pin 14 protrudes inward from the central portion of the inner surface of each side wall section 2.

Formed on the inner surface of the effective section 1 is a phosphor screen 5, which is composed of three phosphor layers that radiate individually in three colors, blue, green, and red. Also, a substantially rectangular shadow mask 6 is located inside the face panel 3 so as to face the screen 5. The shadow mask 6, which has a color selecting function, is fixed to a rectangular mask frame 7. The mask frame is supported on the stud pins 14 by means of elastic holders 15.

On the other hand, an electron gun 9 for emitting three electron beams 8 is located in a neck 7 of the funnel 4. The three electron beams 8 emitted from the gun 9 are deflected by a deflection yoke 24 that is attached to the outside of the funnel 4, and are used to scan the phosphor screen 5 horizontally and vertically through the shadow mask 6. Thereupon, a color image is displayed on the phosphor screen 5.

As shown in FIGS. 1 to 4B, the shadow mask 6 is formed integrally by working a metal sheet with a thickness of, for example, 0.10 to 0.15 mm. The mask 6 includes a curved-surface section 16 in the form of a convex surface and a skirt section 17, which extends substantially at right angles to the curved-surface section and surrounds its whole periphery. The curved-surface section 16 includes a substantially rectangular perforated portion 20 having a large number of electron beam apertures 18 and a nonperforated peripheral edge portion 21 on the outer periphery of the perforated portion.

Each electron beam aperture 18 is composed of a larger hole 18*a* opening in a convex surface 16*a* or the outer surface of the curved-surface section 16 and a smaller hole 18*b* opening in a concave surface 16*b* of the curved-surface section. When the shadow mask 6 is set in the vacuum envelope of the color cathode-ray tube, the larger and smaller holes 18*a* and 18*b* of each electron beam aperture 18 face the phosphor screen 5 and the electron gun 9, respectively.

Figure 3:
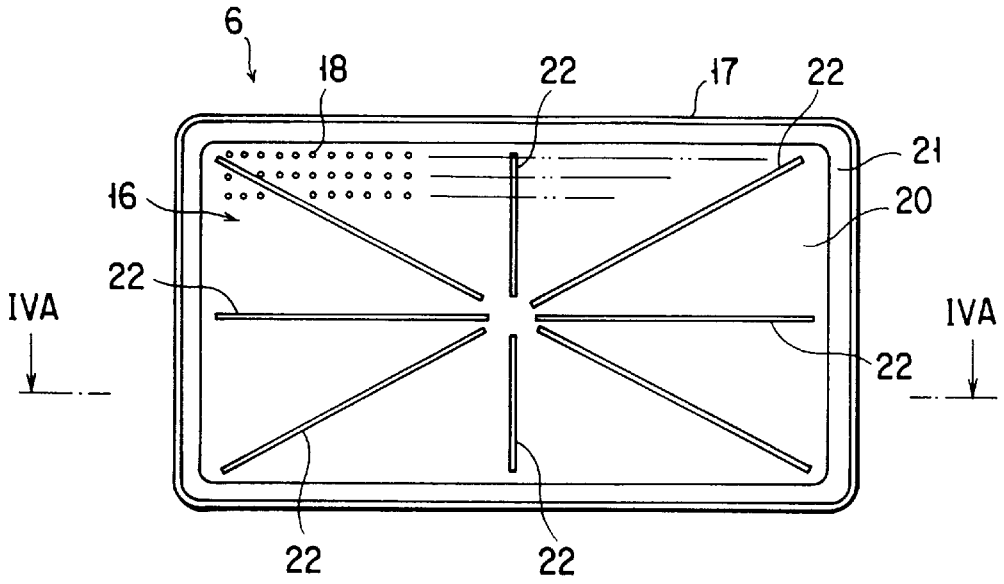
FIG. 3 is a plan view showing the inner surface side of the shadow mask.
Figure 4A:
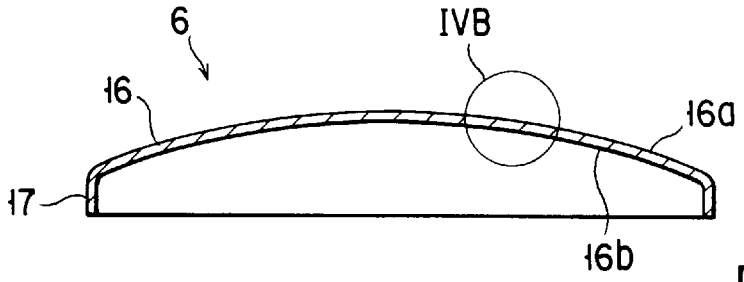
FIG. 4A is a sectional view taken along line IVA—IVA of FIG. 3.
Figure 4B:
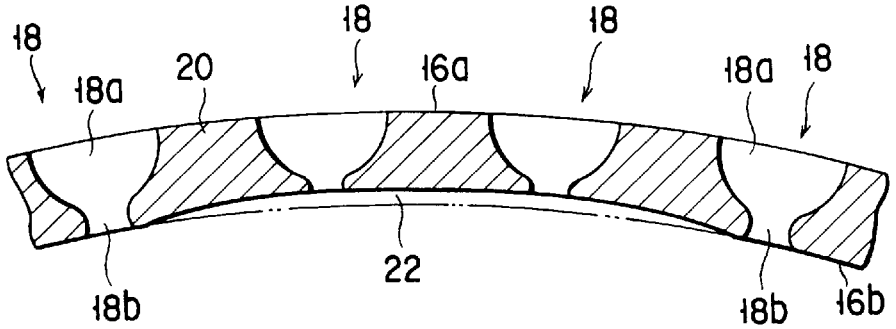
FIG. 4B is an enlarged sectional view of a portion IVB of FIG. 4A.

As shown in FIGS. 3 and 4B, moreover, the concave surface 16*b* or the inner surface of the perforated portion 20 of the shadow mask 6 is provided with a plurality of recesses 22 that are formed by compressing the shadow mask in its thickness direction. In the present embodiment, these recesses 22 are in the form of elongate grooves radially extending substantially from the center of the perforated portion 20 to the peripheral edge thereof. Each recess 22 has a depth of 10 $\mu$m or thereabout.

The following is a description of a method of manufacturing the shadow mask 6 having the aforementioned construction.

In this manufacturing method, a flat mask in the form of a flat plate having the numerous electron beam apertures 18 is first prepared, annealed, and press-molded into a specified shape. Then, the press-molded shadow mask is compression-molded in its thickness direction to form the recesses 22. Thereafter, the shadow mask surface is blackened so that an oxide film is formed thereon.

Figure 5:
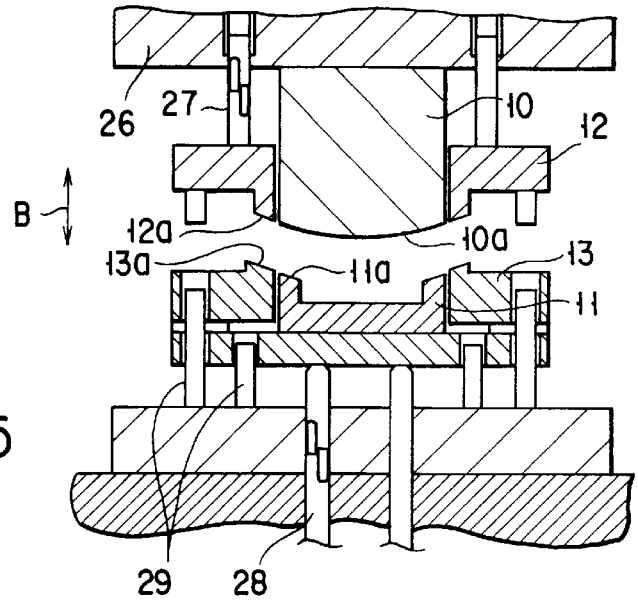
FIG. 5 is a sectional view of a pressing apparatus used in manufacturing the shadow mask.

The following is a detailed description of a press-molding process. As shown in FIG. 5, a pressing apparatus used in this press-molding process comprises a punch 10, knockout 11, blank holder 12, and die 13, which are raised and lowered in the directions indicated by arrow B by a push device 26 and slide mechanisms 27, 28 and 29.

The bottom surface of the punch 10 is a planished convex surface 10*a* that is shaped tracing the curved-surface section 16 to be formed, with some spring-back taken into account. The knockout 11 has an external shape corresponding to that of the punch 10, and only its ring-shaped peripheral edge portion is formed having a concave surface 11*a* that fits the convex surface 1O*a* of the punch 10 throughout the circumference. The blank holder 12 and the die 13 have their respective facing ring-shaped peripheral edge portions 12*a* and 13*a* curved so as to fit each other.

Figure 6A:
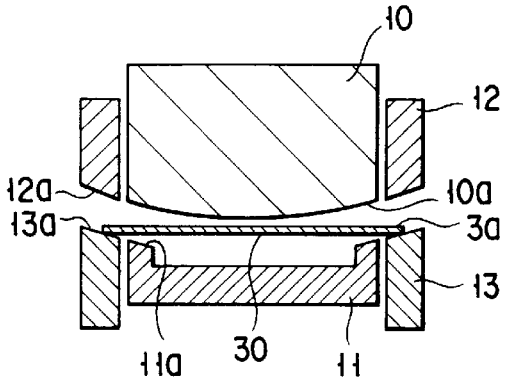
FIGS. 6A to 6D are sectional views schematically showing several steps of a press-molding process for the shadow mask using the pressing apparatus.

In effecting the press molding, a flat mask 30 is first set on the peripheral edge portion 13*a* of the die 13, as shown in FIG. 6A.

Figure 6B:
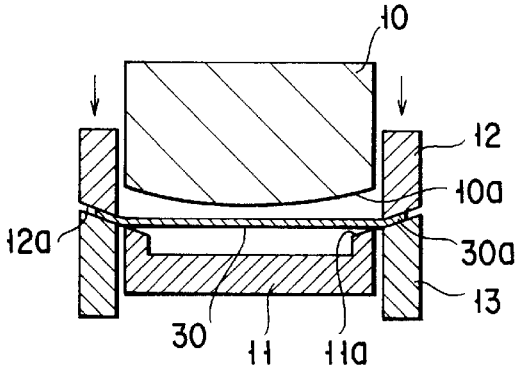
Figure 6C:
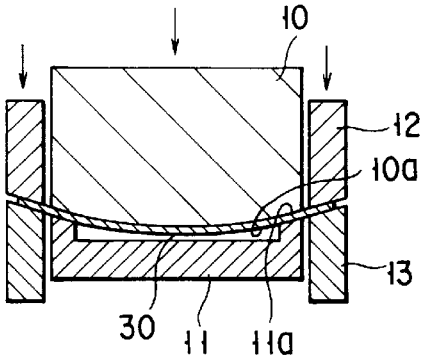

Then, the blank holder 12 is pushed down so that an expected skirt section 30*a* to form the skirt section 17 is held between the peripheral edge portion 13*a* of the die 13 and the peripheral edge portion 12*a* of the holder 12, as shown in FIG. 6B. Thereafter, the punch 10 is pushed down to force the flat mask 30 to spread along the convex surface 1O*a* of the punch 10, thereby curving the perforated portion 20 and the peripheral edge portion 21 into a desired shape, as shown in FIG. 6C. Subsequently, the nonperforated peripheral edge portion 21 is firmly held between the peripheral edge portion of the convex surface 1O*a* of the punch 10 and the concave surface 11*a* at the peripheral edge portion of the knockout 11.

Figure 6D:
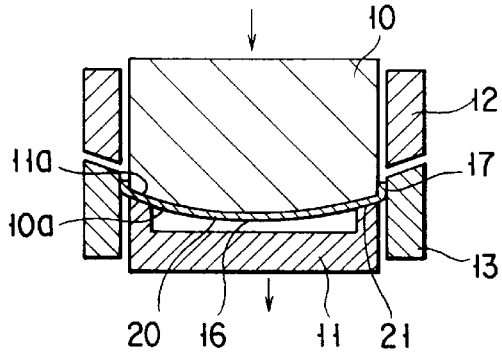

As shown in FIG. 6D, moreover, a force of pressure on the blank holder 12 is eased, and a greater force of pressure is applied to the punch 10, thereby pushing it down. In this process, the punch 10 and the knockout 11 move downward with the peripheral edge portion of the flat mask 30 between them, and are forced into the die 13. Thereupon, the skirt section 17 is formed.

Finally, the forces of pressure on the punch 10 and the blank holder 12 are released, and the punch 10 is pulled up, whereupon the process for press-molding the shadow mask 6 is finished.

Figure 7:
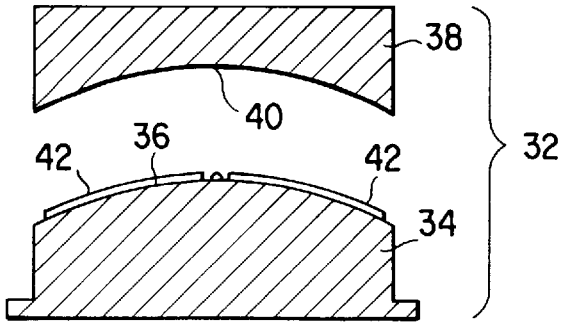
FIG. 7 is a sectional view of mold means used in compressing the shadow mask.
Figure 8:
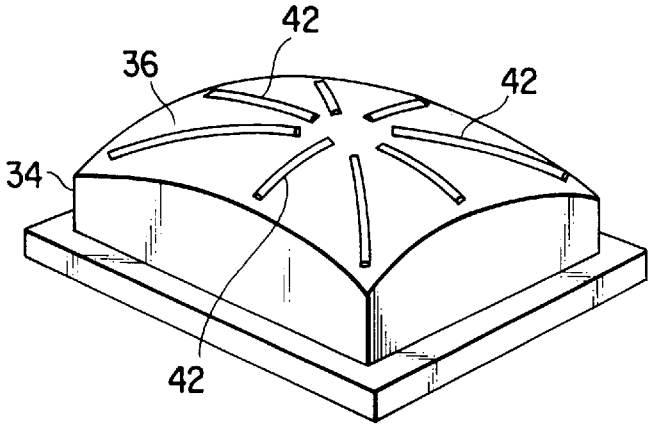
FIG. 8 is a perspective view of a first compression mold of the mold means shown in FIG. 7.

After the press molding is finished in this manner, the shadow mask 6 is subjected to a compression process. As shown in FIGS. 7 and 8, a mold 32 for the compression process is provided with a first compression mold 34 having a convex surface 36 and a second compression mold 38 having a concave surface 40. The first compression mold 34, as a whole, has substantially the same shape as the punch used in the shadow mask press-molding process. The convex surface 36 of the first compression mold 34 corresponds to the concave surface 16*b* of the curved-surface section 16 of the shadow mask 6, and the surface 16 is formed having a plurality of elongate ridges 42 that extend radially. The height of each ridge 42 is adjusted to 3 to 50 μm. The concave surface 40 of the second compression mold 38 has a smooth shape corresponding to the convex surface 16*a* of the curved-surface section 16, and is not provided with any projections.

Figure 9A:
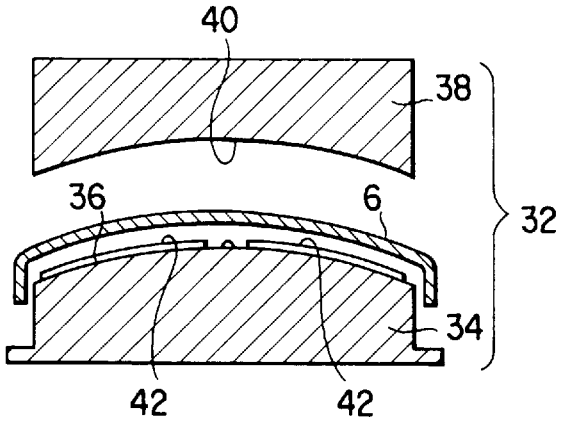
FIGS. 9A and 9B are sectional views schematically showing a compression process for the shadow mask using the mold means of FIG. 7.

The compression process using the above-mentioned mold 32 is executed in the following manner. First, the press-molded shadow mask 6 is placed on the convex surface 36 of the first compression mold 34 in a manner such that its concave surface 16*b* faces the convex surface 36, as shown in FIG. 9A. Then, the second compression mold 38 is put on the shadow mask 6 with its concave surface 40 downward, whereby the shadow mask is sandwiched between the first and second compression molds 34 and 38.

Figure 9B:
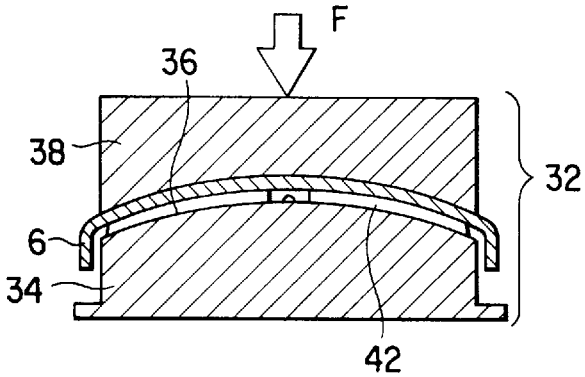

As shown in FIG. 9B, thereafter, an impact force F directed to the first compression mold 34 is applied to the second compression mold 38 from above by means of an impact applying apparatus (not shown). When the force F is applied in this manner, that surface of the shadow mask 6 on the side of the convex surface 16*a* or the larger holes 18*a* is never subjected to any local stress, since it is in planar contact with the concave surface 40 of the second compression mold 38. Since that surface of the shadow mask 6 on the side of the concave surface 16*b* or the smaller holes 18*b* is in linear contact with the ridges 42 of the first compression mold 34, on the other hand, its contact regions on the ridges 42 are subjected to a local stress and compressed in the thickness direction of the shadow mask. Thereupon, the recesses 22 are formed extending radially in the inner surface of the perforated portion 20 of the mask 6. Each recess 22 has a depth of 10 to 40 μm.

Thus, according to the present embodiment, the ridges 42 are provided on the first compression mold 34, which is situated on the side of the smaller holes 18*b* of the shadow mask 6, for the following reason. Each electron beam aperture 18 of the shadow mask 6 is formed by joining together each smaller hole 18*b* on the electron-gun side of the color cathode-ray tube and its corresponding larger hole 18*a* on the phosphor-screen side by etching. The convex surface 16*a* of the shadow mask 6 in which the larger holes 18*a* are formed has more regions to be etched than the concave surface 16*b* in which the smaller holes 18*b* are formed. Thus, the surface on the smaller-hole side, that is, the concave surface 16*b* of the perforated portion 20, has more regions that remain without being etched, and can provide more contact regions on the ridges 42, so that the compression process can be carried out more easily.

Finally, the shadow mask surface is blackened in the conventional method so that an oxide film is formed thereon, whereupon the shadow mask is completed.

According to the shadow mask 6 manufactured in this manner, the elongate groove-shaped recesses 22 or rigid dents attributable to the compression in the thickness direction of the shadow mask are formed in the concave surface 16*b* of the curved-surface section 16 on the side of the smaller holes 18*b*, as mentioned before. The mechanical strength of the shadow mask 6 can be improved by forming these dents by the compression process. If the depth of each recess 22 is about 10 μm in the case where the shadow mask is 0.12 mm thick, the strength of the mask can be improved without deforming the electron beam apertures 18.

The strength of the shadow mask 6 manufactured by the method described above was measured. The mask 6 was not deformed even when it was subjected to an external impact that would deform a conventional shadow mask, and was able to stand a still greater impact. According to the aforementioned manufacturing method, moreover, it is possible to mold a relatively thick shadow mask that cannot be strong enough after it is press-molded and cannot, therefore, be easily molded by the conventional manufacturing method. According to the method described above, furthermore, the shadow mask is compressed in its thickness direction after it is press-molded, so that the same pressing apparatus for the conventional method can be utilized directly.

In the embodiment described herein, the impact force is applied from the side of the second compression mold with the first compression mold thereunder. Alternatively, however, the second compression mold may be situated on the lower side.

Figure 10:
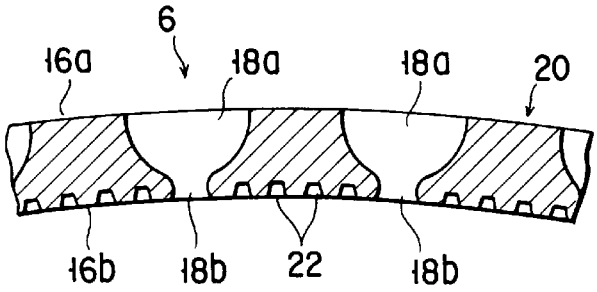
FIG. 10 is an enlarged sectional view showing part of a shadow mask according to another embodiment of the invention.

The dents or recesses 22 in the smaller-hole-side surface of the shadow mask are not limited to the aforesaid shape of an elongate groove, and may be variously modified as required. As shown in FIG. 10, for example, the recesses 22 may be substantially hemispherical in shape.

Figure 11:
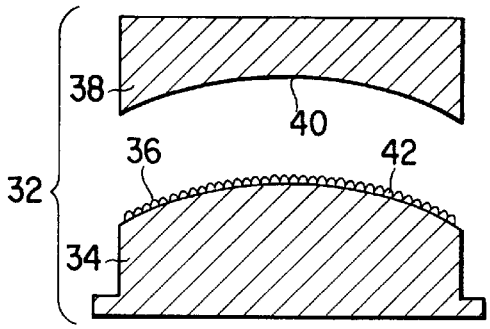
FIG. 11 is a sectional view of mold means used in compressing the shadow mask of the second embodiment.
Figure 12A:
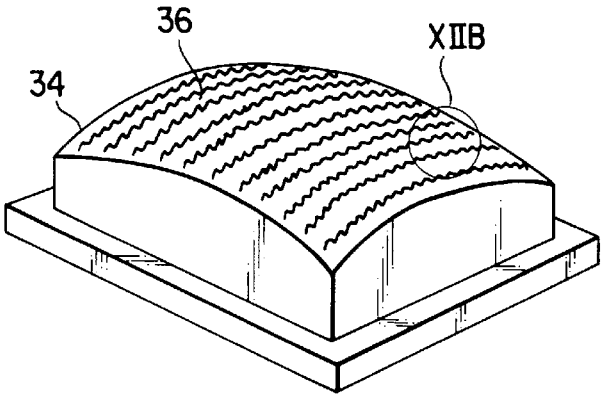
FIGS. 12A and 12B are perspective views of a first compression mold of the mold means shown in FIG. 11.
Figure 12B:
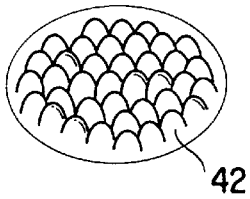

As shown in FIGS. 11, 12A and 12B, the mold 32 used in the manufacture of the shadow mask 6 of this type includes the first and second compression molds 34 and 38, and a large number of metallic spheres, e.g., steel spheres of 4-mm diameter, are embedded substantially in the whole area of the convex surface 36 of the first compression mold 34, thus forming a large number of substantially hemispherical protuberances 42. A convex surface that is obtained by connecting the respective tops of the protuberances 42 corresponds to the concave surface 16*b* of the curved-surface section 16 of the shadow mask 6. The concave surface 40 of the second compression mold 38 has a smooth shape corresponding to the convex surface 16*a* of the curved-surface section 16, and is not planted with any metallic spheres, and therefore, is not provided with any projections thereon.

After the shadow mask 6 is press-molded by the same method as the aforesaid one, it is compressed by means of the mold 32. This shadow mask and the manufacturing method therefor can provide the same functions and effects of the foregoing embodiment.

According to the foregoing embodiment, moreover, the compression process using the mold 32 is carried out after the curved surface is formed by pressing. Alternatively, however, projections may be provided on the punch surface of the pressing apparatus so that a metal sheet can be compressed in its thickness direction as the curved surface is formed by pressing.

Figure 13:
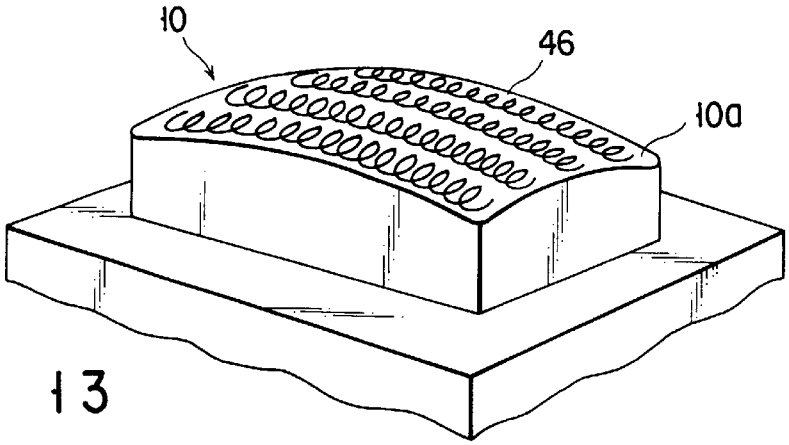
FIG. 13 is a perspective view showing a modification of a punch used in the pressing apparatus.

In this case, the convex surface 10*a* of the punch 10 of the pressing apparatus shown in FIG. 5 is not planished, and is provided with the projections shown in FIG. 8 or 12B. Alternatively, the convex surface 10*a* of the punch 10 may be provided with minute indentations by leaving machining marks 46 attributable to cutting work, without being planished, so that projections of 3 to 50 μm are formed regularly or at random on the surface, as shown in FIG. 13.

In molding the shadow mask 6 by using the punch 10, the flat mask 30 is first set on the peripheral edge portion 13*a* of the die 13, as in the process shown in FIGS. 6A to 6D. Then, the blank holder 12 is pushed down in the direction of arrow C so that the expected skirt section 30*a* to form the skirt section 17 is held between the peripheral edge portion 13*a* of the die 13 and the peripheral edge portion 12*a* of the holder 12. Thereafter, the punch 10 is pushed down to force the flat mask 30 to spread along the convex surface 10*a* of the punch 10, thereby curving the perforated portion 20 and the peripheral edge portion 21 into a desired shape. At the same time, the flat mask 30 is compressed in its thickness direction by the indentations of the convex surface 10*a*, whereby the recesses 22 are formed.

Subsequently, the nonperforated peripheral edge portion 21 is firmly held between the peripheral edge portion of the convex surface 10*a* of the punch 10 and the concave surface 11*a* at the peripheral edge portion of the knockout 11. Next, pressure on the blank holder 12 is eased, and a greater pressure is applied to the punch 10, thereby pushing it down. In this process, the punch 10 and the knockout 11 move downward with the peripheral edge portion of the flat mask 30 between them, and are forced into the die 13. Thereupon, the skirt section 17 is formed.

Finally, the pressure on the punch 10 and the blank holder 12 is released, and the punch 10 is pulled up, whereupon the processes for press-molding and compressing the shadow mask 6 are finished. Thereafter, the shadow mask surface is blackened so that an oxide film is formed thereon, whereupon the shadow mask is completed.

According to the manufacturing method described above, as in the foregoing embodiment, there may be provided a shadow mask with good mechanical strength against an external impact, which can undergo satisfactory plastic working without changing the shape of the electron beam apertures even with use of a thin sheet as its material. Furthermore, the convex surface of the punch need not be planished, so that the mold manufacturing costs can be reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A shadow mask, comprising:

a curved-surface section formed by working a metal sheet and having the shape of a curved surface; and a skirt section surrounding the curved-surface section throughout a circumference of the curved-surface section, the curved-surface section including a perforated portion provided with a plurality of electron beam apertures and a nonperforated peripheral edge portion situated on the outer periphery of the perforated portion, each of the electron beam apertures having a larger hole opening on a convex surface side of the perforated portion and a smaller hole opening on a concave surface side of the perforated portion, the perforated portion having a plurality of compressed, strengthening dents formed in one surface thereof by compressing the perforated portion in the thickness direction thereof, wherein the plurality of compressed strengthening dents radially extend substantially from the center of the perforated portion to the peripheral edge thereof.

2. A shadow mask according to claim 1, wherein the plurality of compressed, strengthening dents radially extend substantially from the center of the perforated portion to the peripheral edge thereof.

3. A shadow mask according to claim 1, wherein the plurality of compressed, strengthening dents are distributed substantially throughout the perforated portion and are substantially in the form of a hemisphere each.

4. A shadow mask according to claim 1, wherein the metal sheet has a thickness of 0.10 to 0.15 mm, and each of the compressed, strengthening dents has a depth of 3 to 50 $\mu$m.

5. A shadow mask comprising:

a curved-surface section having the shape of a curved surface; and a skirt section surrounding the curved-surface section throughout a circumference of the curved-surface section, the curved-surface section including a perforated portion provided with a plurality of electron beam apertures and a nonperforated peripheral edge portion situated on the outer periphery of the perforated portion, the perforated portion having a plurality of recesses, wherein the plurality of recesses radially extend substantially from the center of the perforated portion to the peripheral edge thereof.

* * * * *